US010714868B2

(12) United States Patent
Maesoba et al.

(10) Patent No.: US 10,714,868 B2
(45) Date of Patent: Jul. 14, 2020

(54) WATERPROOF CONNECTOR FOR A BOARD

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Hiroyoshi Maesoba, Mie (JP); Toshifumi Ichio, Mie (JP)

(73) Assignees: AutoNetwoeks Technologies, Ltd., Yokkaichi-shi, Mie (JP); Sumitomo Wiring Systems, Ltd., Yokkaichi-shi, Mie (JP); Sumitomo Electric Industries, Ltd., Osaka-shi, Osaka (JP)

( * ) Notice: Subject to any disclaimer, the term of this patent is extended or adjusted under 35 U.S.C. 154(b) by 39 days.

(21) Appl. No.: 16/070,395

(22) PCT Filed: Mar. 2, 2017

(86) PCT No.: PCT/JP2017/008241
§ 371 (c)(1),
(2) Date: Jul. 16, 2018

(87) PCT Pub. No.: WO2017/163802
PCT Pub. Date: Sep. 28, 2017

(65) Prior Publication Data

US 2019/0044276 A1 Feb. 7, 2019

(30) Foreign Application Priority Data

Mar. 23, 2016 (JP) ..... 2016-057927

(51) Int. Cl.
*H01R 13/52* (2006.01)
*H01R 13/516* (2006.01)
(Continued)

(52) U.S. Cl.
CPC ..... *H01R 13/5221* (2013.01); *H01R 12/515* (2013.01); *H01R 12/71* (2013.01);
(Continued)

(58) Field of Classification Search
CPC ..... H01R 13/5202; H01R 13/5213; H01R 13/5205; H01R 12/515; H01R 12/71; H01R 12/716
See application file for complete search history.

(56) References Cited

U.S. PATENT DOCUMENTS 6,086,411 A * 7/2000 Shinozaki ..... H01R 13/5219 439/188
6,302,707 B1 * 10/2001 Kolar ..... B60R 16/0239 439/188
(Continued)

FOREIGN PATENT DOCUMENTS

JP 2002-231405 8/2002
JP 2002-313486 10/2002
(Continued)

OTHER PUBLICATIONS

International Search Report dated May 23, 2017.

*Primary Examiner* — Xuong M Chung Trans
(74) *Attorney, Agent, or Firm* — Gerald E. Hespos; Michael J. Porco; Matthew T. Hespos

(57) ABSTRACT

It is aimed to suppress a projecting amount from a printed board. A male connector (M) is mounted on a printed board (P). A male connector housing (30) is formed with an inner receptacle (31) formed into a tubular shape open in one direction and fittable in a sealed state into a space between a terminal accommodating portion (4) and an outer tube portion (6) in a female connector (F) and an outer receptacle (33) formed into a tubular shape open in the same direction as the inner receptacle (31) while surrounding the inner receptacle (31), the outer tube portion (6) of the female
(Continued)

connector (F) is fittable between the inner receptacle (31) and the outer receptacle (33), and the outer receptacle (33) is mountable on the printed board (P).

4 Claims, 7 Drawing Sheets

(51) Int. Cl.
*H01R 12/71* (2011.01)
*H01R 12/51* (2011.01)

(52) U.S. Cl.
CPC ..... *H01R 12/716* (2013.01); *H01R 13/516* (2013.01); *H01R 13/52* (2013.01); *H01R 13/5202* (2013.01)

(56) References Cited

U.S. PATENT DOCUMENTS

| | | | | |
|---|---|---|---|---|
| 6,666,708 | B2 * | 12/2003 | Saito | H01R 12/727 439/372 |
| 7,140,908 | B2 * | 11/2006 | Katsuma | H01R 13/4364 439/489 |
| 9,711,910 | B2 * | 7/2017 | Zhao | H01R 13/6581 |
| 2010/0099279 | A1 * | 4/2010 | Homme | H01R 13/5202 439/78 |
| 2012/0040553 | A1 | 2/2012 | Tashiro | |

FOREIGN PATENT DOCUMENTS

| | | |
|---|---|---|
| JP | 2009-9845 | 1/2009 |
| JP | 2011-34825 | 2/2011 |
| JP | 2015-115129 | 6/2015 |

* cited by examiner

WATERPROOF CONNECTOR FOR A BOARD

BACKGROUND

Field of the Invention

The invention relates to a waterproof connector for a board.

Description of the Related Art

Japanese Unexamined Patent Publication No. 2002-231405 discloses a configuration in which a waterproof connector is mounted on a printed board and these are accommodated in a sealed case. This waterproof connector is composed of a terminal holding portion for holding a terminal fitting and a tubular receptacle projecting forward from the terminal holding portion. The terminal holding portion of the waterproof connector is mounted near an end edge of the board so that the receptacle projects out from the board. A mating connector then is fit to the receptacle of the waterproof connector. Thus, the receptacle projects out from the case a large distance.

An external force easily acts on the receptacle that projects out from the board. Such an external force that acts on the receptacle before the receptacle is accommodated into the case may adversely affect a part where a terminal fitting is soldered to a printed board.

The invention was completed on the basis of the above situation and aims to provide a waterproof connector for a printed board that is capable of maximally suppressing a projecting amount from a printed board.

SUMMARY

A waterproof connector for a board of the present invention is to be connected to a female connector formed with a terminal accommodating portion accommodating a female terminal fitting and an outer tube surrounding the terminal accommodating portion. The waterproof connector for a board includes a male connector housing formed with a forwardly open tubular inner receptacle that can fit in a sealed state into a space between the terminal accommodating portion and the outer tube of the female connector. The male connector housing further has a forwardly open tubular outer receptacle that surrounds the inner receptacle. The outer tube can fit between the inner receptacle and the outer receptacle. The outer receptacle is mountable on a printed board. A male terminal fitting has one end provided in the inner receptacle and another end connected to a circuit formed on the printed board.

The waterproof connector for a board is configured such that the female connector is fit inside the outer receptacle. Thus, a part of the male connector housing relating to connection to the female connector can be arranged within a formation region of the board, and the projection of the waterproof connector from an end edge of the printed board can be prevented maximally.

The male connector housing having the male terminal fitting mounted therein may be accommodated into a case together with the printed board. The interior of the case defines a waterproof space. A protruding wall may protrude on an opening edge part of the outer receptacle and may be mounted in a sealed state on a window that is open in the case. According to this configuration, the male connector is mounted on the case using the protruding wall formed on the opening edge. Thus, the projection from the case can be suppressed when the waterproof connector is accommodated into the case.

The male connector housing may be formed with a terminal holding portion for holding the male terminal fitting, and the outer receptacle may be formed into a stepped shape toward the printed board in a height direction with respect to the terminal holding portion. The printed board may be cut to form an escaping portion for avoiding interference with the outer receptacle. According to this configuration, when the male connector is mounted on the printed board, a lower side of the male connector housing can be dropped into the escaping portion. Thus, a mounting height of the male connector with respect to the printed board can be reduced. This can contribute to a size reduction of the case by reducing an interior height of the case when the male connector is accommodated into the case together with the printed board.

DETAILED DESCRIPTION

Next, a specific embodiment of a waterproof connector for a board of the invention is described with reference to the drawings.

Figure 3:
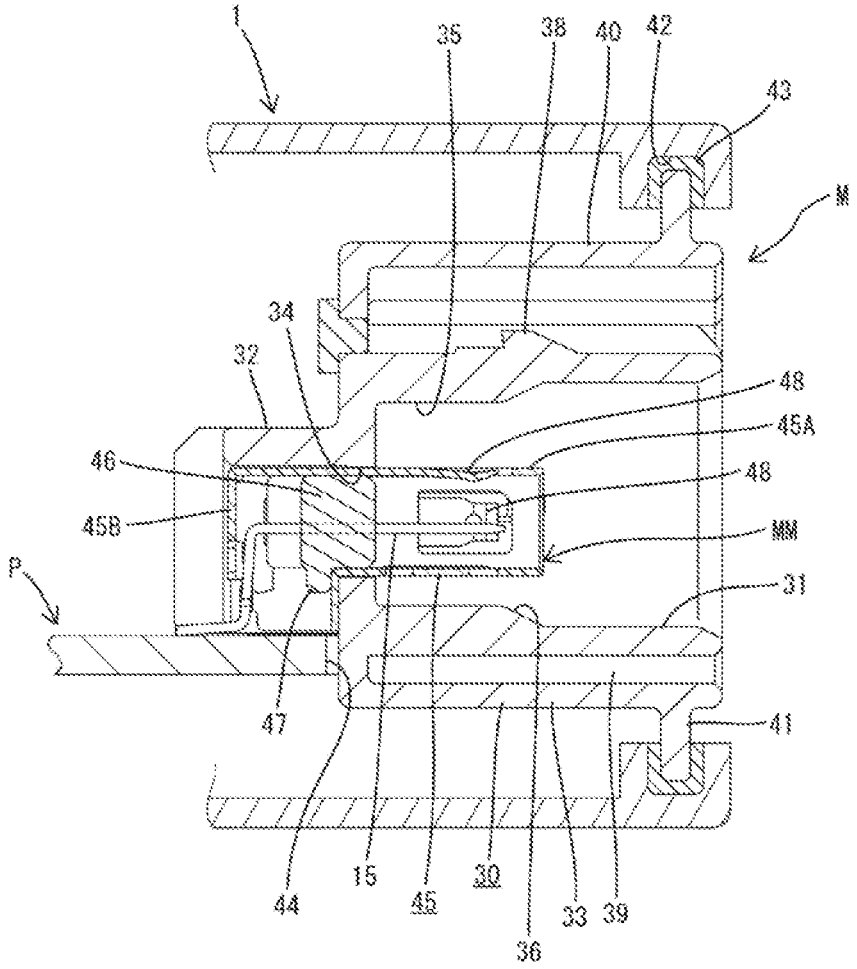
FIG. 3 is a section along A-A of FIG. 2.

The waterproof connector for a board of this embodiment is a male connector M mounted on a printed board P. The male connector M in this embodiment is accommodated in a case 1 having a waterproof space inside together with the printed board P, as shown in FIG. 3.

(Female Connector F)

Figure 5:
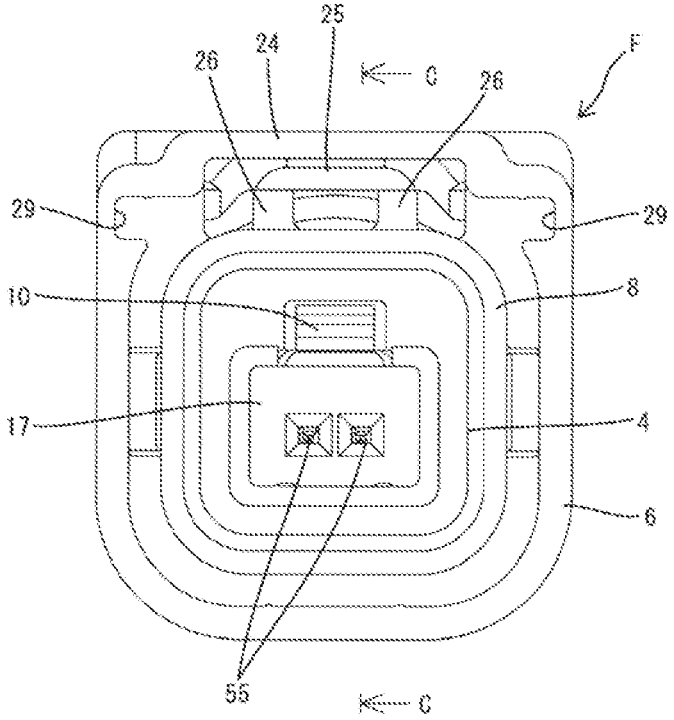
FIG. 5 is a front view of the female connector.
Figure 6:
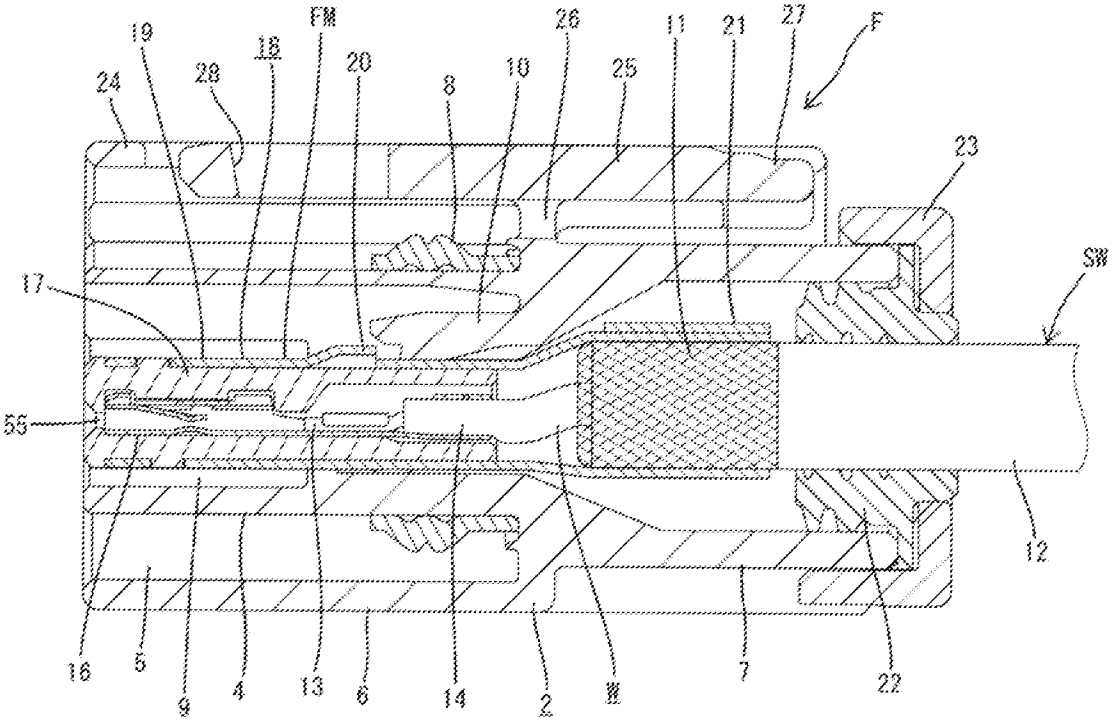
FIG. 6 is a section along C-C of FIG. 5.

A female connector F as a connection partner of the male connector M is described on the basis of FIGS. 5 and 6. The female connector F includes a female connector housing 2 made of synthetic resin. The female connector housing 2 includes a terminal accommodating portion 4 for accommodating female terminal fittings 3 and an outer tube 6 for surrounding the terminal accommodating portion 4 with an insertion space 5 defined between the terminal accommodating portion 4 and the outer tube portion 6. A sealing tube 7 is connected behind the terminal accommodating portion 4.

As shown in FIG. 6, a seal ring 8 is fit on the outer peripheral surface of a back part of the terminal accommodating portion 4. The seal ring 8 seals between the male and female connectors M, F when the male and female connectors M, F are connected, and a terminal accommodation chamber 9 is formed inside the terminal accommodating portion 4. A rear part of the terminal accommodation chamber 9 communicates with the inside of the sealing tube 7. The terminal accommodation chamber 9 can accommodate a later-described female terminal module FM connected to an end part of one shielded cable SW. Further, a deflectable locking lance 10 is formed inside the terminal accommodation chamber 9 for retaining an outer conductor 18 for the female terminal fittings 3.

Figure 7:
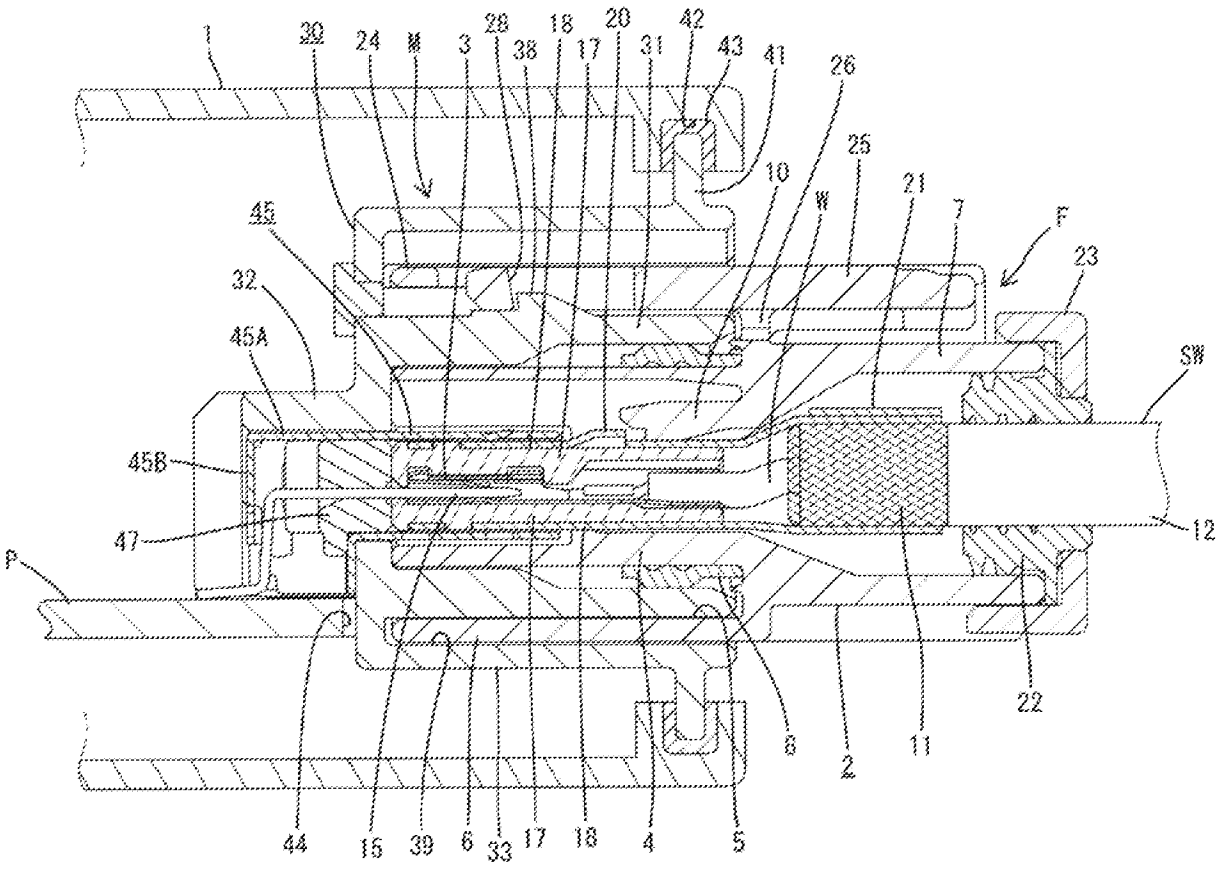
FIG. 7 is a side view in section showing a connected state of the male and female connectors.

The shielded cable SW in this embodiment is formed such that two wires (only one wire is shown in FIGS. 6 and 7) are covered collectively by a braided wire 11 and a sheath 12.

A core 13 is exposed at an end part of each wire W and an inner sheath 14 covering the core 13 is exposed behind the exposed part of the core 13. The braided wire 11 that collectively surrounds the inner sheaths 14 of the wires is folded onto the outer surface of the sheath 12 in the exposed part of the inner sheath 14.

The female terminal fitting 13 is formed by bending a conductive thin metal plate material into a predetermined shape and connected to each wire W. The female terminal fitting 3 includes a rectangular tube 16 connectable to a male terminal fitting 15, and a rear part of the rectangular tube 16 is connected to the core 13 of each wire. The female terminal fittings 3 are collectively accommodated inside a dielectric 17 made of an insulating synthetic resin material. Although not shown in detail, the dielectric 17 is divided vertically into two sections except at a front wall. The female terminal fittings 13 are set temporarily in one divided-half of the dielectric 17, and the other divided-half of the dielectric 17 is united to accommodate the female terminal fittings 13 in a retained state. Insertion openings 55 open coaxially with the female terminal fittings in the front wall of the dielectric and the male terminal fittings are insertable therein. The dielectric 17 is further accommodated in the outer conductor 18.

The outer conductor 18 is formed by bending a conductive thin metal plate material into a predetermined shape. The outer conductor 18 also is divided into upper and lower sections. Similar to a relationship between the dielectric 17 and the female terminal fittings 3, the dielectric 17 accommodating the female terminal fittings 3 is set temporarily in one divided-half of the outer conductor 18 and, thereafter, accommodated in a retained state in the outer conductor 18 by uniting the upper and lower sections of the outer conductor 18. In this way, the female terminal fittings 3 constitute the female terminal module FM by being integrated with the dielectric 17 and the outer conductor 18.

A front part of the outer conductor 18 includes a rectangular accommodating tube 19, and a locking projection 20 projects on an outer surface of the accommodating tube 19 for locking to the locking lance 10. A barrel 21 is connected behind the accommodating tube 18 and is crimped to the folded part of the braided wire 11. The barrel 21 crimped to the braided wire 11 is located in the sealing tube 7 when the female terminal module FM is accommodated in the terminal accommodation chamber 9.

As shown in FIG. 6, a rubber plug 22 is fit behind the barrel 21 on the shielded cable SW and is fit into an opening on the rear end of the sealing tube 7 in a watertight manner. Further, a rubber plug holder 23 is mounted on the rear end of the sealing tube 7 to retain the rubber plug 22.

Figure 1:
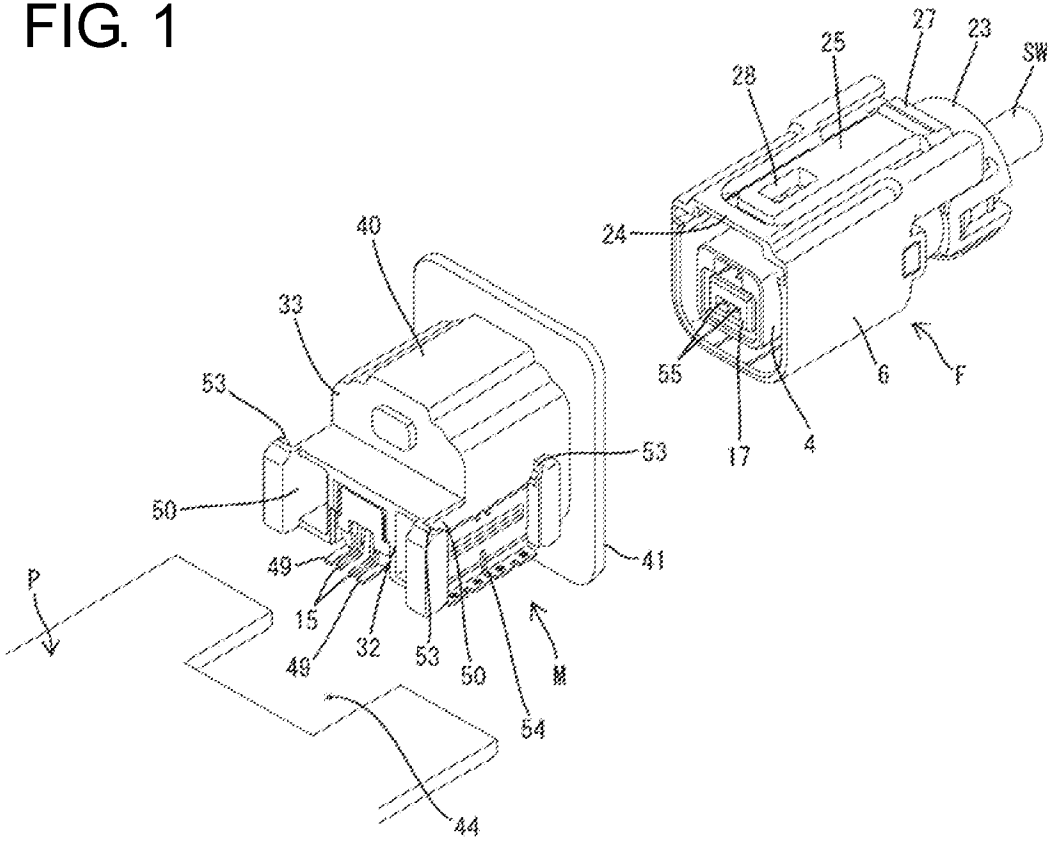
FIG. 1 is a perspective view showing male and female connectors and a printed board.

As shown in FIGS. 1 and 5, the outer tube 6 is substantially in the form of a rectangular tube that opens forward. The upper surface of the outer tube 6 is substantially entirely open except at a front end part, and the front end part couples the upper edges of walls on both sides of the outer tube 6 in a width direction via a bridge 24.

A lock arm 25 for holding a connected state to the male connector M is disposed in the outer tube 6 between the walls on both sides. The lock arm 25 is disposed along the front-rear direction and is substantially flush with the upper edges of the walls on the both sides. As show in FIG. 6, the lock arm 25 includes left and right supports 26 rising from the upper surface of the sealing tube 7 in a central part in a length direction, and can be pivoted in a seesaw manner with the supports 26 as a center. A rear part of the lock arm 25 serves as an unlocking portion 27 for unlocking the lock arm 25, and a lock hole 28 is open in a front part.

As shown in FIG. 5, two guide grooves 29 are formed in both widthwise side parts of an upper part of the outer tube 6 of the female connector housing 2. The guide grooves 29 are formed along the front-rear direction, and function to guide a connecting operation when the male and female connectors M, F are connected in proper orientations and restrict reverse connection by interfering with the male connector M when an attempt is made to connect the female connector F in a vertically inverted posture.

(Male Connector M)

Next, the male connector M is described with reference to FIGS. 1 to 4. The male connector M includes a male connector housing 30 made of synthetic resin. As shown in FIG. 3, the male connector housing 30 includes a forwardly open inner receptacle 31, a terminal holding portion 32 connected behind the inner receptacle 31 and configured to hold the male terminal fittings 15, and an outer receptacle 33 surrounding the inner receptacle 31.

The terminal holding portion 32 projects rearward from the rear surface of the inner receptacle 31. A mounting window 34 is open in the rear surface of the inner receptacle 31 to allow communication between the inner receptacle 31 and the terminal holding portion 32.

The inner receptacle 31 is substantially in the form of a rectangular tube that opens forward, and the terminal accommodating portion 4 of the female connector F can fit therein. As shown in FIG. 3, an inner back part of the inner receptacle 31 is slightly narrower over the entire periphery to form a positioning portion 35. Conversely, the inside of the inner receptacle 31 before the positioning portion 35 is wider to allow the terminal accommodating portion 4 of the female connector F to be fit and guided smoothly to the positioning portion 35 by a guiding slope 36 formed on a front edge part of the positioning portion 35 when the male and female connectors M, F are connected. As a result, the terminal accommodating portion 4 of the female connector F is fit in the positioning portion 35 without rattling.

Figure 2:
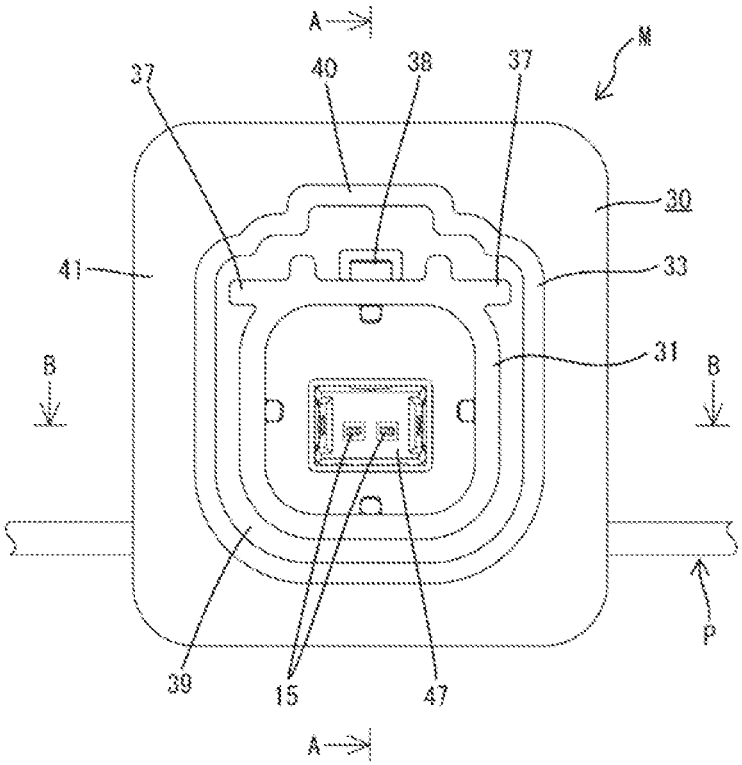
FIG. 2 is a front view of the male connector.

As shown in FIG. 2 two protruding pieces 37 protrude out in the width direction on both sides of an upper part of the inner receptacle 31. The protruding pieces 37 are formed along the front-rear direction on the outer surface of the inner receptacle 31, and can be aligned with the guide grooves 29 of the female connector F and fit along the guide grooves 29 when the male and female connectors M, F are connected in proper orientations.

A lock 38 projects in a widthwise central part of the upper surface of the inner receptacle 31, and is locked into the lock hole 28 of the lock arm 25 when the male and female connectors M, F are connected.

The outer receptacle 33 is a forwardly open substantially rectangular tube surrounding the inner receptacle 31. As shown in FIG. 3, opening edges of the inner receptacle 31 and the outer receptacle 33 are substantially flush with each other. A fitting space 39 is defined between the outer and inner receptacles 33, 31 and receives the outer tube 6 of the female connector F when the male and female connectors M, F are connected. Note that, as shown in FIG. 2, a widthwise central part of the outer receptacle 33 bulges up over the entire length to define a bulging portion 40. The deflection of the lock arm 25 is allowed by expanding an upper side of the fitting space 39.

As shown in FIG. 1, a protruding wall 41 protrudes along the entire periphery near a front end part of the outer receptacle 33. As shown in FIG. 3, the entire edge of the protruding wall 41 can fit into a mounting groove 42 formed along the entire periphery of an opening part of the case 1 via a sealing member 43. Note that the case 1 including the opening part is divided vertically into sections that are united in a sealed state.

Figure 4:
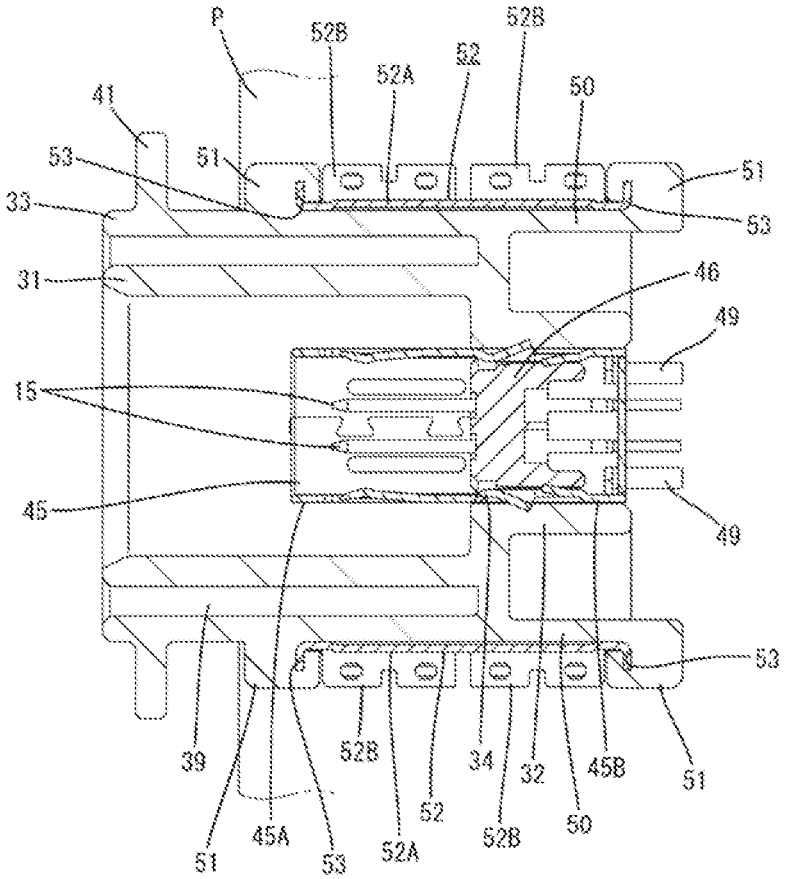
FIG. 4 is a section along B-B of FIG. 2.

The male connector M is fixed on the printed board P having circuits formed thereon. As shown in FIG. 1, an escaping portion 44 in the form of a rectangular cut is formed in a central part of the front edge of the printed board P. As shown in FIG. 3, a lower side of the outer receptacle 33 of the male connector is dropped and fit into the escaping portion 44. When the outer receptacle 33 is dropped into the escaping portion 44, the front edge of the printed board substantially aligns with the front edges of front mounting protrusions 51, as shown in FIG. 4.

As shown in FIG. 3, the terminal holding portion 32 projects rearward from the rear surface of the inner receptacle 31, and is placed on the printed board P on a back side of the escaping portion 44. A male terminal module MM including two male terminal fittings 15 is mounted in the terminal holding portion 32. The male terminal module MM is composed of the male terminal fittings 15, a dielectric 46 and an outer conductor 45.

As shown in FIG. 3, the male terminal fitting 15 is formed by a square wire material made of conductive metal. A front side of the male terminal fitting 15 extends horizontally, and projects forward via the outer conductor 45 in the inner receptacle 31. After extending rearward through the inner receptacle 31, the male terminal fitting 15 is bent substantially at a right angle toward the printed board P and a lower end part thereof is bent further at a substantially right angle to extend rearward and connected to an unillustrated circuit on the printed board P by soldering.

Intermediate parts of horizontally extending sections of the male terminal fittings 15 penetrate through the dielectric 46 made of an insulating synthetic resin material. The dielectric 46 is formed into a substantially block shape and holds the male terminal fittings 15 arranged in parallel in the width direction. A stopper 47 projects down on the lower surface of the dielectric 46.

The outer conductor 45 accommodates the male terminal fittings 15 and the dielectric 46 inside. The outer conductor 45 is formed by bending a plate made of conductive metal. The outer conductor 45 includes a body 45A formed into a substantially rectangular tube. The body 45A is press-fit through the mounting window 34 and projects horizontally into the inner receptacle 31.

As shown in FIG. 3, resilient tongues 48 are disposed respectively on three of side surfaces of the body 45A except the lower surface. Each resilient tongue 48 is cantilevered forward with a free front end and a tip that projects slightly inward of the body 45A in a natural state. When the male and female connectors M, F are connected, the outer conductor 45 of the male connector M is fit outside the outer conductor 18 of the female connector F so that the male and female terminal fittings 15, 3 are connected to each other and the tip of each resilient tongue 48 resiliently contacts the corresponding outer surface of the outer conductor 18 of the female connector F.

In the outer conductor 45, a support 45B bent substantially at a right angle to extend down and is formed continuously behind the body 45A. The support 45B is formed into a rearwardly open substantially C-shaped horizontal cross-section, and the inside thereof communicates with the body 45A. As shown in FIG. 3, the stopper 47 is locked to a front wall in the support 45B so that the dielectric cannot move farther forward.

As shown in FIG. 4, two leads 49 extend rearward from lower end parts of both widthwise sides of a rear part of the support 45B. The leads 49 are arranged in parallel to sandwich rear parts of the male terminal fittings 15 from outer sides. The leads 49 are connected to a ground circuit of the printed board P by soldering.

As shown in FIG. 4, two extending walls 50 extend rearward from the rear ends of both widthwise side surfaces of the outer receptacle 33 while being flush with each other. The extending walls 50 are arranged across and at a predetermined interval from the terminal holding portion 32 in the width direction. As shown in FIG. 4, the positions of the rear ends of the extending walls 50 substantially align with the rear end parts of the male terminal fittings 15 and the rear ends of the both leads 49.

Pairs of front and rear mounting protrusions 51 project at positions near the protruding wall 41 on both widthwise side surfaces of the outer receptacle 33 and rear end parts of both extending walls 50. As shown in FIG. 4, the mounting protrusions 51 are cut along a height direction from upper ends to form locking grooves 53 for mounting a peg 52.

The peg 52 is formed of a metal plate material and has a base plate 52A and legs 52B formed on the lower end edge of the base plate 52A and is bent substantially at a right angle. Both end parts of the base plate 52A in a length direction are press-fit respectively into the locking grooves 53 of the mounting protrusions 51. A slit 54 is formed by cutting to extend from a central part of the lower edge of the base plate 52A in the length direction. The front and rear legs 52B are formed across this slit 54 and are fixed to the printed board P by soldering.

As described above, a part of the peg 52 is mounted on the outer surface of the outer receptacle 33, i.e. the peg 52 is disposed to overlap with a range relating to connection to the female connector in the front-rear direction (connecting direction). In other words, a range of the male connector M to be mounted on the printed board P and the connection range thereof to the female connector F overlap in the front-rear direction.

Next, functions and effects of this embodiment configured as described above are described. In connecting the male and female connectors M, F, the terminal accommodating portion 4 of the female connector F is fit into the inner receptacle 31 of the male connector M and the outer tube 6 is fit into the fitting space 39 between the inner receptacle 31 and the outer receptacle 39. When the male and female connectors M, F are connected, the lock hole 28 of the lock arm 25 is locked to the lock projection 38 of the male connector M. Thus, the male and female connectors M, F are locked in a connected state. In the connected state of the male and female connectors M, F, the male and female terminal fittings 15, 3 are connected to establish electrical conduction.

A conventional male connector M includes no outer receptacle 33. Since the female connector F is mounted on the outer surface of the male connector M at the time of connection in a conventional case, the male connector M has to be arranged with a part relating to connection to the female connector F protruding from the printed board P, i.e. outside a formation region of the printed board P to prevent the female connector F from interfering with the printed board P in a connected state. Thus, if the male connector M receives an external force, it may adversely affect a part soldered to the printed board P.

In contrast, the male connector M of this embodiment is formed with the outer receptacle 33 and the female connector F is fit inside the outer receptacle 33, as described above. Thus, the male connector M including the part to be connected to the female connector F can be arranged within the formation region of the printed board P, and an influence of an external force on the soldered part can be alleviated.

Further, the male connector conventionally is structured such that the part to be mounted on the printed board P continues behind a part to be connected to the female connector F without overlapping in the front-rear direction. Thus, there has been a problem that the male connector M becomes long in the front-rear direction. However, the range of the male connector M of this embodiment to be mounted on the printed board P (range where the pegs 52 are mounted) overlaps with the connection range to the female connector F in the front-rear direction, as described above. Thus, the male connector M can be made shorter in the front-rear direction as compared to the conventional configuration described above.

The male connector M is mounted by fitting the protruding wall 41 in a sealed state into the mounting groove 42 formed in the opening part of the case 1. Since the inside of the case 1 itself serves as a waterproof space, the male connector M can be installed in a waterproof environment. Further, the protruding wall 41 is receded only slightly from a connection surface of the male connector M. Thus, a projecting amount of the male connector M from the case 1 can be small.

The male connector M of this embodiment has a step in a height direction from the terminal holding portion 32 to the lower side of the outer receptacle 33. Even with the thus formed male connector M, the printed board P is formed with the escaping portion 44 and the lower side of the outer receptacle 33 is dropped into the escaping portion 44. In this way, a mounting height of the male connector M with respect to the printed board P can be reduced. This can contribute to a size reduction of the case 1 by reducing an interior height of the case 1 when the male connector M is accommodated into the case 1 together with the printed board P.

The invention is not limited to the above described and illustrated embodiment. For example, the following embodiments also are included in the scope of the invention.

Although the waterproof connector for a board (male connector M) installed in the case 1 is illustrated in the above embodiment, a place of installation should not be limited. In short, the waterproof connector for a board may be installed in a place where waterproofness is required.

Although the shielded cable SW is connected to the female terminal fittings 3 in the above embodiment, the invention is also applicable to non-shielded cables and terminal fittings having no shielding function.

Although the male terminal fittings 15 are mounted on the surface of the printed board P by soldering in the above embodiment, through holes may be provided and male terminal fittings may be inserted into the through holes and soldered or may be press-fit instead of being soldered.

LIST OF REFERENCE SIGNS

1 . . . case
3 . . . female terminal fitting
15 . . . male terminal fitting
30 . . . male connector housing
31 . . . inner receptacle
32 . . . terminal holding portion
33 . . . outer receptacle
39 . . . fitting space
41 . . . protruding wall
44 . . . escaping portion
F . . . female connector
M . . . male connector
P . . . printed board

The invention claimed is:

1. A waterproof connector for a board, the waterproof connector to be connected to a female connector formed with a terminal accommodating portion accommodating a female terminal fitting and an outer tube spaced from and surrounding the terminal accommodating portion to define an insertion space therebetween, comprising:

a male connector housing formed with a rear wall, a forwardly open tubular inner receptacle projecting forward from the rear wall, the inner receptacle fit in a sealed state into the insertion space between the terminal accommodating portion and the outer tube of the female terminal fitting, and a forwardly open outer receptacle projecting from the rear wall and spaced outward from the inner receptacle to define a clearance between the outer receptacle and the inner receptacle around an entire periphery thereof, the outer tube being configured to fit between the inner receptacle and the outer receptacle, the outer receptacle being mountable on a printed board; and a male terminal fitting having one end provided in the inner receptacle and the other end connected to a circuit formed on the printed board.

2. The waterproof connector of claim 1, wherein the male connector housing having the male terminal fitting mounted therein is accommodated into a case together with the printed board, the interior of the case defining a waterproof space, and a protruding wall protruding on an opening edge part of the outer receptacle, the protruding wall to be mounted in a sealed state on a window open in the case.

3. The waterproof connector of claim 1, wherein the male connector housing has a terminal holding portion for holding the male terminal fitting, the outer receptacle has a stepped shape toward the printed board in a height direction with respect to the terminal holding portion, and the printed board is cut to form an escaping portion for avoiding interference with the outer receptacle.

4. A connector assembly, comprising:

a printed board having a front edge and an escaping portion cut into the front edge of the printed board;

a female connector formed with a terminal accommodating portion accommodating a female terminal fitting and an outer tube spaced from and surrounding the terminal accommodating portion to define an insertion space therebetween;

a waterproof connector including a male connector housing formed with a forwardly open tubular inner receptacle in a sealed state into the insertion space between the terminal accommodating portion and the outer tube of the female terminal fitting and a forwardly open outer receptacle surrounding the inner receptacle to define a clearance between the outer receptacle and the inner receptacle into which the outer tube is fit, the outer receptacle being at least partially accommodated in the escaping portion of the printed board; and a male terminal fitting having opposed front and rear ends, the rear end connected to a circuit formed on the printed board and the front end provided in the inner receptacle at a position rearward of the front edge of the printed board.

* * * * *